US006213644B1

(12) United States Patent
Henderson et al.

(10) Patent No.: US 6,213,644 B1
(45) Date of Patent: Apr. 10, 2001

(54) MULTIPLY BAG WITH TEAR STRIP OPENING MECHANISM

(75) Inventors: Tony Henderson, Victoria (AU); Steven G. Oliphant, Moore, SC (US); John R. Allen, Tifton, GA (US)

(73) Assignee: International Paper Company, Purchase, NY (US)

( * ) Notice: Subject to any disclaimer, the term of this patent is extended or adjusted under 35 U.S.C. 154(b) by 0 days.

(21) Appl. No.: 09/373,256

(22) Filed: Aug. 12, 1999

(51) Int. Cl.[7] ..... B65D 33/00

(52) U.S. Cl. ..... 383/205; 383/66; 383/109; 383/125

(58) Field of Search ..... 383/205, 206, 383/109, 66, 125, 126

(56) References Cited

U.S. PATENT DOCUMENTS 2,998,911 * 9/1961 Hahn et al. ..... 383/205
3,090,541 * 5/1963 Janda ..... 383/205 X
3,291,377 * 12/1966 Eggen ..... 383/205 X
3,515,336 * 6/1970 Kobza ..... 383/205
3,554,437 * 1/1971 Kimsey ..... 383/205 X
3,566,752 * 3/1971 Dreher ..... 383/205 X
4,480,752 * 11/1984 Jacobs ..... 383/205

FOREIGN PATENT DOCUMENTS

139692 * 12/1934 (AT) ..... 383/126
610580 * 12/1960 (CA) ..... 383/125
1292332 * 3/1962 (FR) ..... 383/125
701731 * 12/1953 (GB) ..... 383/125

* cited by examiner

*Primary Examiner*—Jes F. Pascua
(74) *Attorney, Agent, or Firm*—Watov & Kipnes, P.C.

(57) ABSTRACT

A multiply bag and method of forming the same in which the inner ply of the bag has a longitudinal extending tear strip assembly grippable by the user to facilitate opening of the bag.

9 Claims, 1 Drawing Sheet

MULTIPLY BAG WITH TEAR STRIP OPENING MECHANISM

FIELD OF THE INVENTION

The present invention is generally directed to a multiply bag typically formed of multiple layers of a bag construction material such as strong, pliable paper materials alone or in conjunction with plastic materials. The bag is constructed so as to store a variety of products including dry cement, fertilizers, seed and the like. In accordance with the present invention, the multiply bag is provided with at least one readily accessible tear strip assembly which enables the bag to be easily opened in the longitudinal direction of the bag.

BACKGROUND OF THE INVENTION

Multiply bags for storing a variety of products including cement, fertilizer, seed and the like are known. Such bags are typically made of multiple plies including an inner ply and an outer ply and one or more optional middle plies. The inner ply and the outer ply typically have opposed ends with a non-linear but generally complimentary profile to enable proper formation of the bag including the sealing of the opposed ends. In a typical construction, the multiply bag has a closed end and a sealable open end which is capable of receiving a storable product such as cement, as for example through a sleeve having a product-receiving opening or spout. Once the storable product is inserted into the open end of the bag, the bag is sealed. Access to the storable product contained within the bag is typically performed by ripping one of the ends of the bag or the body of the bag.

At times it is difficult for the user to open the bag by ripping and thus resort may be had to a sharp object such as a knife, the end of a shovel or the like. Opening a bag in this manner often leads to spilling of the stored product, in part due to the pressure applied to the bag and the contents therein by the user. In addition, when a bag is opened in this manner, the stored product will spill over into a relatively large area which can result in time consuming cleanup and loss of product. Still further, the use of sharp instruments such as a knife can lead to serious injury.

It would therefore be an advantage in the art if a multiply bag could be opened with minimum strain and without risk of injury to the user. It would also be beneficial to provide a bag which can be opened in a user friendly manner without loss of product typical of conventional methods of opening a multiply bag. It would be a further advance in the art if a system of opening the bag could be inexpensively adapted to existing multiply bags which is readily accessible to the user.

SUMMARY OF THE INVENTION

The present invention is generally directed to a multiply bag which employs a system for opening a bag in the longitudinal direction thereof which is easy to perform and minimizes the loss of product because little if any pressure is exerted on the bag itself. Methods of manufacturing the multiply bag also constitute a part of the present invention.

In a particular aspect of the present invention there is provided a multiply bag and method of manufacturing the same comprising:

a) at least two layers of a bag construction material which are secured together to form a closed end and a sealable open end for receiving a storable product within the bag, said at least two layers comprising an inner ply layer and an outer ply layer;

b) said inner and outer ply layers having opposed ends, the opposed ends having a profile enabling the opposed ends of the inner and outer plies to be secured to form said closed end and sealable open ends of the bag;

c) one of said opposed ends of the inner ply layer having a projection and the other of said opposed ends having a notch aligned with said projection; and d) at least one tearable strip of material extending from the projection to the notch, said strip being accessible so that when the bag is filled with said product the projection having a portion of the tearable strip attached thereto may be pulled thereby opening the bag from the projection to the notch.

BRIEF DESCRIPTION OF THE DRAWINGS

The following drawings in which like reference characters indicate like parts are illustrative of embodiments of the invention and are not intended to limit the invention as encompassed by the claims forming part of the application.

DETAILED DESCRIPTION OF THE INVENTION

The present invention is directed to a multiply bag such as stand up bags, pinch closure bags, sewn up bags and the like, for storing a storable product which employs at least one readily accessible tear strip assembly for opening the multiply bag in the longitudinal direction. The tear strip assembly enables the user to open the bag in the longitudinal direction in a manner which minimizes the spilling of the contents thereof and reduces the risk of injury by eliminating the need to use sharp instruments to open the bag. The tear strip assembly may be positioned in a variety of locations along the width of the multiply bag so long as it is operational to open the bag and does not interfere with the construction of the closed end and sealable open end of the multiply bag.

Figure 1:
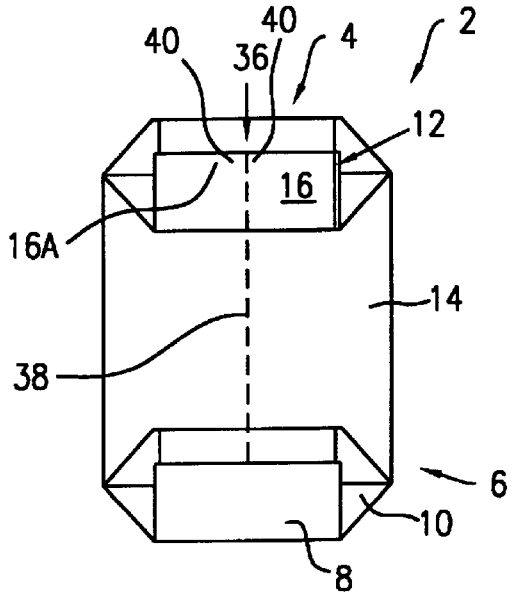
FIG. 1 is a bottom view of a multiply bag in accordance with the present invention.

Referring to FIG. 1 there is shown an embodiment of a multiply bag 2 having a top end 4 and a bottom, closed end 6. The top end 4 and the bottom end 6 are, apart from the tearable strip assembly of the present invention, formed in a conventional manner known to those of ordinary skill in the art. The bag is typically formed by the sealing together of at least two plies, as for example three plies, of a bag construction material typically of paper, which may have an inner ply of plastic to provide protection of the contents against moisture (e.g. polyethylene, polypropylene and the like). As used herein the term "sealing" shall mean any method by which the bag may be closed to effectively store the contents therein. A common method of sealing is through the use of adhesives, pastes and the like. Other methods include heat sealing, ultrasonic sealing and the like.

As shown in FIG. 1, the bottom closed end 6 of the bag is formed by the sealing (e.g. pasting) of a flap 8 onto a base 10. As previously indicated this construction is conventional in the art. The top end of the bag 4 typically is constructed in the form of a sleeve which includes a product receiving opening 12 through which the storable product may be inserted into the body of the bag 14. The opening 12 may later be sealed by heat sealing, adhesives or the like.

The top end 4 of the bag includes a flap 16 and a base 18 which are sealed in a manner similar to the flap in base 8, 10 of the bottom end 6 of the bag. As explained hereinafter, it is preferred for the flap 16 to include an unsealed portion 16A which enables ready access to the tear strip assembly.

Figure 2:
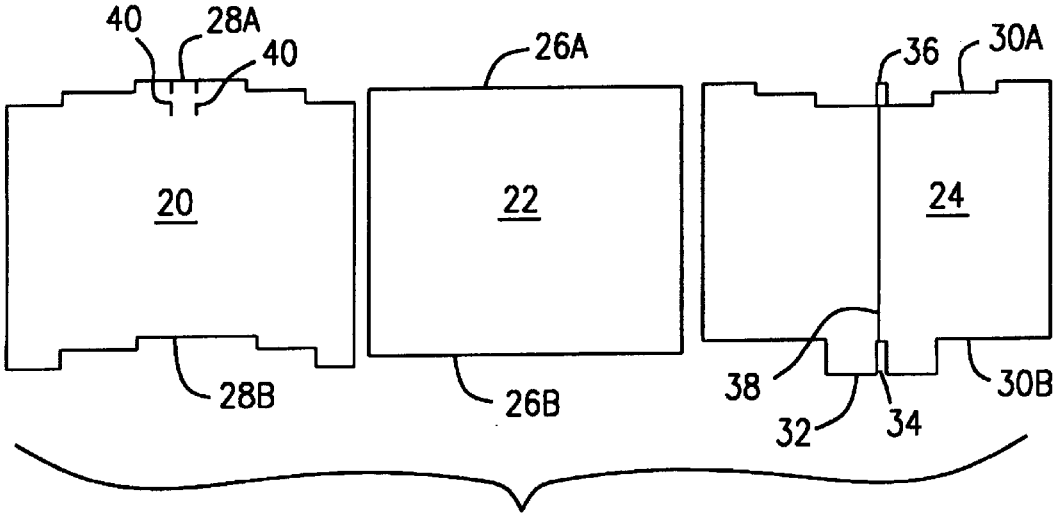
FIG. 2 is a top view of each of an inner ply layer, an outer ply layer, and a middle ply layer used to form a multiply bag in accordance with the present invention.

As previously indicated, multiply bags are constructed from multiple ply layers of a bag construction material. An example of a multiply construction is shown in FIG. 2 which includes an outer ply 20, a single middle ply 22 and an inner ply 24. It will be understood that one or more middle plies may be employed in a multiple ply bag construction. The three plies are typically made of a paper material although the inner ply may be made of plastic as previously indicated. Typically, the middle ply 22 has opposed ends 26A and 26B which are linear or stepped and parallel to each other. The outer ply 20 and the inner ply 24 have respective opposed ends 28A, 28B and 30A and 30B which are not linear, but rather typically have a stepped configuration.

As indicated in FIG. 2, the end 28A of the outer ply 20 has a stepped, outwardly directed profile while the opposed end 28B has a stepped inner directed profile which is complimentary in shape to the end 28A. The end 28A is used to form the flap 16 and thus may include perforations 40 as hereinafter described to facilitate access to the tear strip material.

The inner ply 24 has an end 30A which is a stepped inner directed profile similar to that of end 28B of the outer ply. The opposed end 30B is linear except for the presence of an outwardly extending portion 32 having a notch 34 therein as explained hereinafter. In accordance with the present invention, the end 30A of the inner ply 24 is provided with a projection 36. Extending from the projection 36 to the base of the notch 34 of the inner most ply 24 is a strip 38 of a tearable material which will enable the user to open the bag in the longitudinal direction thereof. As shown specifically in FIG. 1, the tear strip assembly is pulled from the top end 4 to the bottom end 6 of the multiply bag 2. It will be understood that it is within the scope of the invention to provide at least one tear strip assembly so that the bag may be opened from the bottom end 6 to the top end 4.

The multiple plies 20, 22 and 24 shown in FIG. 2 are brought together in conventional bag construction machines known as a tuber and a bottomer. The ply forming materials are first cut to a predetermined to form a tube. The tube is sent to a bottomer which forms the sealed bottom end and the top end of the bag. An example of such machines are those produced by Windmoeller & Hoelscher Corp.

Prior to sealing to form the bag shown in FIG. 1, at least one tearable strip of material such as a plastic material (e.g. polyethylene, polypropylene and the like) is provided in the manner shown in FIG. 2. As shown specifically in FIG. 1, a single tearable strip assembly is positioned midway of the width of the bag. It will be understood that the tearable strip assembly may be positioned off center so long as it may be accessed by the user and does not interfere with the construction of the sealed ends of the bag.

The fully constructed bag is shown in FIG. 1. In accordance with the present invention, there is access to the projection 36 which can be gripped by the user. The slight exertion of a pulling force on the projection 36 can cause the bag to open because the tearable strip 38 is pulled in the longitudinal direction of the bag 2. The projection 36 may be sealed to the flap 16 throughout the use of an adhesive or the like.

As previously indicated, the flap 16 of the top end 4 is comprised of an unsealed portion 16A which is proximate to the tearable strip assembly. The unsealed portion can be moved by the user to provide ready access to the projection 36 extending from the end 30A of the inner ply 24.

In a preferred form of the invention, the unsealed portion of the flap 16A (constituting the upper portion of the ply 20 including the end 28A) is provided with a pair of opposed perforations 40 which provide an initial cut in the bag when the projection 36 is pulled by the user. The employment of the perforations 40 facilitates initiation of the opening process.

Other modifications of the present invention within the spirit and scope of the invention claimed herein would be apparent to those of ordinary skill in the art. Such modifications include the employment of multiple tearable strips and the inclusion of multiple middle ply layers.

What is claimed is:

1. A multi-ply bag comprising:

a) at least two layers of a bag construction material which are secured together to form a closed end and a sealable open end for receiving a storable product within the multi-ply bag, said at least two layers comprising an inner ply layer and an outer ply layer;

b) said inner ply layer having a first arrangement of opposed stepped ends and said outer ply layer having a second arrangement of opposed stepped ends such that the inner ply and outer ply layers are sealed together to form said multi-ply bag, a portion of one of the opposed stepped ends of the inner play layer is not sealed to the outer ply layer and a portion of one of the opposed stepped ends of the outer ply layer is not sealed to the inner ply layer, the opposed ends having a profile enabling the opposed ends to be secured to form said closed and sealable open ends of the multi-ply bag;

c) one of said opposed ends of the inner ply layer having a projection and the other of said opposed ends of the inner ply layer having a notch aligned with said projection; and d) at least one tearable strip of material extending from the projection to the notch, said strip being accessible so that when the multi-ply bag is filled with said storable product, the projection having a portion of the tearable strip attached thereto may be pulled thereby opening the multi-ply bag from the projection to the notch.

2. The multi-ply bag of claim 1 comprising at least three ply layers including at least one middle ply layer positioned between the outer ply layer and the inner ply layer.

3. The multi-ply bag of claim 1 further comprising a pair of spaced apart perforations positioned adjacent to the tearable strip to assist the user in gripping the projection.

4. The multi-ply bag of claim 1 wherein the unsealed portion of the outer ply layer is movable by the user to enable access to the projection.

5. The multi-ply bag of claim 1 wherein one tearable strip of material is positioned midway of the width of the multi-ply bag.

6. The multi-ply bag of claim 1 wherein one of the stepped ends of the outer ply layer comprises a pair of opposed first end portions, a pair of opposed second end portions and a central end portion extending between the opposed second end portions, said central end portion having a width at least equal to the width of the tearable strip.

7. The multi-ply bag of claim 6 wherein the central end portion has a width equal to the width of the tearable strip.

8. The multi-ply bag of claim 6 wherein the central end portion has a width greater than the width of the tearable strip.

9. The multi-ply bag of claim 6 wherein one of the stepped ends of the inner ply comprises first, second and central end portions complimentary to the corresponding end portions of the outer ply wherein the end portions of the outer and inner plies are adhered together except for the tear strip.

* * * * *